US009533852B2

(12) United States Patent
Suzuki et al.

(10) Patent No.: US 9,533,852 B2
(45) Date of Patent: Jan. 3, 2017

(54) SHEET EJECTING DEVICE, IMAGE FORMING SYSTEM, AND SHEET EJECTING METHOD

(71) Applicants: Junya Suzuki, Miyagi (JP); Kiichiro Goto, Kanagawa (JP); Masahiro Tamura, Kanagawa (JP); Shuuya Nagasako, Kanagawa (JP); Keisuke Sugiyama, Tokyo (JP); Tomohiro Furuhashi, Kanagawa (JP); Kyosuke Nakada, Kanagawa (JP); Kazuya Yamamoto, Kanagawa (JP); Tomomichi Hoshino, Kanagawa (JP); Akira Kunieda, Tokyo (JP); Takahiro Watanabe, Kanagawa (JP); Takamasa Matsumoto, Kanagawa (JP); Kazunori Konno, Miyagi (JP); Youhei Niitsuma, Kanagawa (JP)

(72) Inventors: Junya Suzuki, Miyagi (JP); Kiichiro Goto, Kanagawa (JP); Masahiro Tamura, Kanagawa (JP); Shuuya Nagasako, Kanagawa (JP); Keisuke Sugiyama, Tokyo (JP); Tomohiro Furuhashi, Kanagawa (JP); Kyosuke Nakada, Kanagawa (JP); Kazuya Yamamoto, Kanagawa (JP); Tomomichi Hoshino, Kanagawa (JP); Akira Kunieda, Tokyo (JP); Takahiro Watanabe, Kanagawa (JP); Takamasa Matsumoto, Kanagawa (JP); Kazunori Konno, Miyagi (JP); Youhei Niitsuma, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/739,447

(22) Filed: Jun. 15, 2015

(65) Prior Publication Data

US 2015/0353315 A1 Dec. 10, 2015

Related U.S. Application Data

(63) Continuation of application No. 14/012,429, filed on Aug. 28, 2013, now Pat. No. 9,085,436.

(30) Foreign Application Priority Data

Sep. 5, 2012 (JP) ..... 2012-195359

(51) Int. Cl.
*B65H 31/34* (2006.01)
*B65H 31/26* (2006.01)
(Continued)

(52) U.S. Cl.
CPC ..... *B65H 31/34* (2013.01); *B65H 29/246* (2013.01); *B65H 31/10* (2013.01); *B65H 31/26* (2013.01);
(Continued)

(58) Field of Classification Search
CPC ... B65H 29/245; B65H 29/246; B65H 29/247; B65H 29/248; B65H 2404/74; B65H 2404/7414; B65H 2406/12; B65H 31/34; B65H 31/26; B65H 31/10; B65H 2406/1222; B65H 2406/423
(Continued)

(56) References Cited

U.S. PATENT DOCUMENTS 4,132,400 A 1/1979 Naramore
4,372,550 A 2/1983 Woods
(Continued)

FOREIGN PATENT DOCUMENTS

JP 2002370863 A 12/2002
JP 2003-002500 A 1/2003
(Continued)

OTHER PUBLICATIONS

Office Action for corresponding Japanese Application No. 2012195359 dated Oct. 20, 2015 and English translation thereof.

*Primary Examiner* — David H Bollinger
(74) *Attorney, Agent, or Firm* — Harness, Dickey & Pierce, P.L.C.

(57) ABSTRACT

A sheet ejecting device includes: a sheet ejecting unit configured to eject a sheet; a stacking unit on which the sheet that is ejected by the ejecting unit is stacked; an aligning unit configured to align the sheet in a direction orthogonal to the direction in which the sheet is ejected; and a blowing unit configured to be provided to the aligning unit and blow a wind toward the ejected sheet.

10 Claims, 16 Drawing Sheets

(51) Int. Cl.

| | |
|---|---|
| ***B65H 43/04*** | (2006.01) |
| ***B65H 29/24*** | (2006.01) |
| ***B65H 31/10*** | (2006.01) |
| ***B65H 31/38*** | (2006.01) |

(52) U.S. Cl.
CPC ..... *B65H 31/38* (2013.01); *B65H 43/04* (2013.01); *B65H 2406/1222* (2013.01); *B65H 2406/423* (2013.01); *B65H 2511/214* (2013.01); *B65H 2511/414* (2013.01); *B65H 2511/416* (2013.01); *B65H 2801/27* (2013.01)

(58) Field of Classification Search
USPC ..... 271/211, 220, 223
See application file for complete search history.

(56) References Cited

U.S. PATENT DOCUMENTS

| | | | |
|---|---|---|---|
| 5,429,475 | A | 7/1995 | Mohr |
| 5,460,361 | A | 10/1995 | Mokler |
| 6,522,841 | B2 | 2/2003 | Horikoshi |
| 7,451,980 | B2 | 11/2008 | Tamura et al. |
| 7,661,671 | B2 | 2/2010 | Yamazaki et al. |
| 8,682,240 | B2 | 3/2014 | Fukita et al. |
| 2012/0161379 | A1 | 6/2012 | Matsui et al. |
| 2013/0134659 | A1 | 5/2013 | Konno et al. |
| 2013/0147105 | A1 | 6/2013 | Sugiyama et al. |

FOREIGN PATENT DOCUMENTS

| | | | |
|---|---|---|---|
| JP | 2003-002612 | A | 1/2003 |
| JP | 2011-057313 | A | 3/2011 |
| JP | 2012140202 | A | 7/2012 |

SHEET EJECTING DEVICE, IMAGE FORMING SYSTEM, AND SHEET EJECTING METHOD

CROSS-REFERENCE TO RELATED APPLICATIONS

This application is a continuation application of and claims priority under 35 U.S.C. §120/121 to U.S. application Ser. No. 14/012,429 filed Aug. 28, 2013, which claims priority under 35 U.S.C. §119 to Japanese Patent Application No. 2012-195359 filed in Japan on Sep. 5, 2012, the entire contents of each of which are hereby incorporated herein by reference.

BACKGROUND

1. Field of the Invention

Example embodiments relate to a sheet ejecting device, an image forming system, and a sheet ejecting method. Particularly, example embodiments relate to a sheet ejecting device that blows a wind to a carried sheet-like recording medium, such as paper, recording paper, transfer paper, and an OHP sheet, (hereinafter, referred to as "sheet") when it is aligned and stacked; an image forming system that includes the sheet ejecting device and an image forming apparatus, such as a copier, a printer, a facsimile machine, or a digital multi-function machine; and a sheet ejecting method that is performed by the ejecting device.

2. Description of the Related Art

Conventional sheet processing devices are known and widely used that perform various types of post processing, such as alignment, stapling, folding and binding, and that are thus referred to as sheet post processing devices. In recent years, requirements for such sheet post processing devices to deal with sheets have greatly increased. Particularly, regarding color image forming apparatuses, the portion of printing performed on coated sheets (hereinafter, "coated paper") that enable clear images for leaflets, flyers, etc. is increasing. Normally, coated paper has the following characteristics:

1) high surface smoothness,
2) high coherence between sheets, and
3) low Clark hardness.

These characteristics may lower the stackability of coated paper.

A technique to improve stackability is known in which an air layer is formed by using fans in order to stack an ejected sheet in a normal position. Regarding such a technique, the invention disclosed in Japanese Laid-open Patent Publication No. 2003-002512 is known.

The invention is characterized by a sheet ejecting device that includes a sheet ejection table that is provided with side fences on its both sides for regulating both side edges of a sheet that is ejected from a printing unit; blower fans; air outlets from which air sent from the blower fans is blown onto the back side of the sheet that falls into the bottom of the ejection table; an environmental temperature checking unit that checks the environmental temperature; and a blower controller that changes the air blown from the blower fans according to the checked environmental temperature.

The blowing of air by using fans that is disclosed in Japanese Laid-open Patent Publication No. 2003-002512 can prevent buckling in the transfer direction. However, because ejected sheets are electrically charged, ejected sheets may cohere to each other due to static electricity.

An object of the invention is to prevent ejected sheets from cohering to one another and to have good accuracy in alignment of the stacked sheets.

SUMMARY

It is an object of example embodiments to at least partially solve the problems in the conventional technology.

According to example embodiments, there is provided: a sheet ejecting device comprising: a sheet ejecting unit configured to eject a sheet; a stacking unit on which the sheet that is ejected by the ejecting unit is stacked; an aligning unit configured to align the sheet in a direction orthogonal to the direction in which the sheet is ejected; and a blowing unit configured to be provided to the aligning unit and blow a wind toward the ejected sheet.

Example embodiments also provide an image forming system including a sheet ejecting device, wherein the sheet ejecting device comprises: a sheet ejecting unit configured to eject a sheet; a stacking unit on which the sheet that is ejected by the ejecting unit is stacked; an aligning unit configured to align the sheet in a direction orthogonal to the direction in which the sheet is ejected; and a blowing unit configured to be provided to the aligning unit and blow a wind toward the ejected sheet.

Example embodiments also provide a method of ejecting a sheet, comprising the steps of: ejecting, by a sheet ejecting unit, a sheet; stacking, on a stacking unit, a sheet that is ejected by the ejecting step; aligning, by an aligning unit, each sheet that is stacked in the stacking step in a direction orthogonal to the direction in which the sheet is ejected; blowing, by a blowing unit configured to be provided to the aligning unit, a wind toward the ejected sheet when the sheet is aligned in the aligning step.

The above and other objects, features, advantages and technical and industrial significance of this invention will be better understood by reading the following detailed description of presently preferred embodiments of the invention, when considered in connection with the accompanying drawings.

DETAILED DESCRIPTION OF EXAMPLE EMBODIMENTS

Example embodiments relate to forming an air layer between stacked sheets that have high surface smoothness and thus easily cohere one another by blowing winds toward both ends of the sheets in their width direction, thereby reducing coherence between the sheets and preventing misalignment of sheets in the width direction. Example embodiments will be described with reference to the accompanying drawings.

Figure 1:
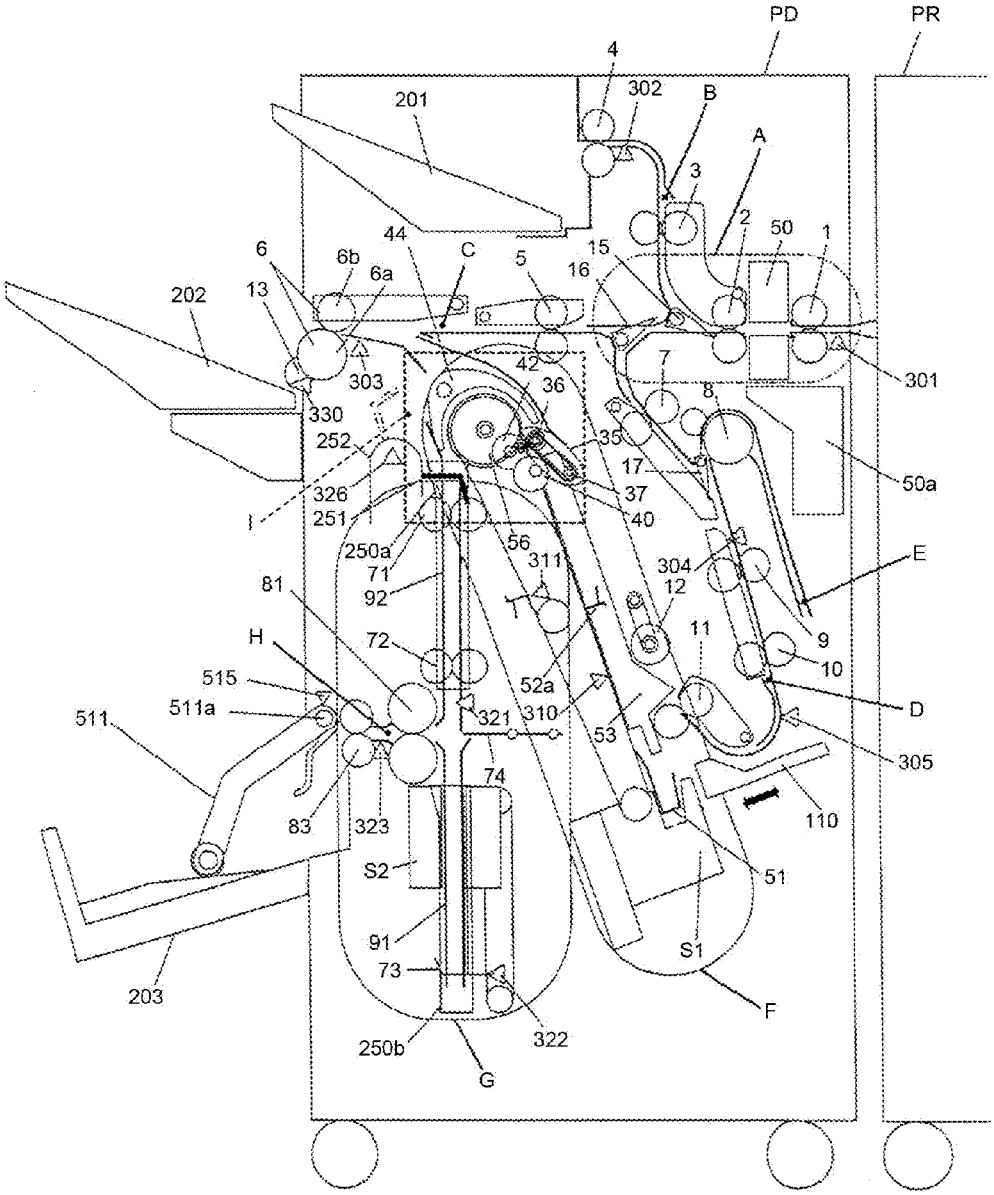
FIG. 1 is a system configuration diagram of a system that includes a sheet post-processing device that serves as a sheet processing device; and an image forming apparatus, according to an example embodiment.

FIG. 1 is a system configuration diagram of an image forming system that includes a sheet post-processing device PD that serves as a sheet processing device; and an image forming apparatus PR, according to an example embodiment.

The image forming apparatus PR shown in FIG. 1 includes at least an image processing circuit that converts input image data into printable image data; an optical writing device that performs optical writing on a photosensitive element according to image signals that are input from the image processing circuit; a developing device that develops, with toner, a latent image formed by the optical writing on the photosensitive element; a transfer device that transfers the toner image, which is visualized by the developing device, to a sheet; and a fixing device that fixes the transferred toner image on the sheet. The image forming apparatus PR sends the sheet with the fixed toner image thereon to the sheet post processing device PD that performs desired post processes. The image forming apparatus PR employs electrography as described above. Alternatively, any known image forming apparatus, such as an ink-jet image forming apparatus and a thermal-transfer image forming apparatus, may be used. In the embodiment, the image processing circuit, the optical writing device, the developing device, the transfer device and the fixing device constitute the image forming apparatus.

The sheet post processing device PD is attached to a side of the image forming apparatus PR. A sheet that is ejected from the image forming apparatus PR is guided to the sheet post processing device PD. The sheet post processing device PD has transfer paths A, B, C, D and H. The sheet is first transferred to the transfer path A that has a post processing unit (a punching unit 50 serving as a holing unit) that performs a post process on one sheet.

The transfer path B guides the sheet to an upper tray 201 via the transfer path A. The transfer path C guides the sheet to a shift tray 202. The transfer path D guides the sheet to a process tray F where alignment and stapling etc. are performed (hereinafter, also referred to as "end-face stapling process tray"). Sheets are sorted from the transfer path A to the transfer paths B, C and D by bifurcating claws 15 and 16.

The sheet post processing device can perform various processes, such as holing (the punching unit 50), paper alignment and end stapling (a jogger fence 53 and an end-face stapler S1), paper alignment and middle stapling (a middle stapling upper jogger fence 250*a*, a middle stapling lower jogger fence 250*b*, and a middle stapler S2), paper sorting (the shift tray 202), and center-folding (a folding plate 74 and a folding roller 81). The transfer path A and the following transfer paths B, C, and D are selected according to the process. The transfer path D includes a paper storage E. On the downstream side of the transfer path D, the end-stapling process tray F, a middle-stapling center-folding process tray G, and a sheet ejection transfer path H are provided.

On the transfer path A that is upstream with respect to the transfer paths B, C and D and is common to them, an entrance sensor 301 that detects a sheet that is received from the image forming apparatus PR and an entrance roller 1 and, on their downstream side, the punching unit 50, a punched-piece hopper 50*a*, a transfer roller 2, and first and second bifurcating claws 15 and 16 are sequentially arranged. The first and second bifurcating claws 15 and 16 are held by springs (not shown) in the state shown in FIG. 1 (initial state). First and second solenoids (not shown) are turned on to drive the bifurcating claws 15 and 16. By selecting on/off of the first and second solenoids, the combination of the bifurcating directions of the first and second bifurcating claws 15 and 16 is changed to sort sheets to the transfer paths B, C and D.

When a sheet is guided to the transfer path B, the state in FIG. 1 is kept, i.e., the first solenoid is kept off (the first bifurcating claw 15 faces down in its initial state) so that the sheet is ejected to the upper tray 201 via a transfer roller 3 and an upper sheet ejecting roller 4.

When a sheet is guided to the transfer path C, the first and second solenoids are turned on (the second bifurcating claw 16 faces up in its initial state) so that the first bifurcating claw 15 rotates up and the bifurcating claw 16 rotates down from the state shown in FIG. 1. This allows the sheet to be ejected toward the shift tray 202 via a transfer roller 5 and a sheet ejecting roller pair 6 (6*a* and 6*b*). In this case, the sheet is sorted by the sheet ejecting roller pair 6 (6*a* and 6*b*), a sending-back roller 13, a sheet surface detection sensor 330, the shift tray 202, a shift mechanism that causes the shift tray 202 to reciprocate along the direction orthogonal to the direction in which sheets are transferred, and a shift tray lifting up/down mechanism that lifts up/down the shift tray 202.

When a sheet is guided to the transfer path D, the first solenoid for driving the first bifurcating claw 15 is turned on and the second solenoid for driving the second bifurcating claw 16 is turned off so that the bifurcating claws 15 and 16 rotate up and thus the sheet is guided from the transfer roller 2 toward the transfer path D via a transfer roller 7. The sheet that is guided to the transfer path D is then guided to the end-face stapling process tray F and the sheet that has been aligned and stapled on the end-face stapling process tray F is sorted by a guide member 44 to the transfer path C that leads to the shift tray 202 or is sorted to the middle-stapling center-folding process tray G (hereinafter, also referred to as "middle stapling process tray"). If sheets are guided to the shift tray 202, a sheet bundle PB is ejected from the sheet ejecting roller pair 6 to the shift tray 202. The sheet bundle PB guided toward the middle stapling process tray G is folded and stapled in the middle stapling process tray G and ejected to a lower tray 203 via the sheet ejection transfer path H and a lower sheet ejecting roller 83.

A bifurcating claw 17 is arranged on the transfer path D that is held in the state shown in FIG. 1 by a low-load spring (not shown). After the tail of the sheet transferred by the transfer roller 7 passes through the bifurcating claw 17, at least the transfer roller 9 among the transfer rollers 9 and 10 and a stapling sheet ejecting roller 11 is rotated back to send back the sheet along a turn guide 8. This allows the sheet to be guided to the sheet storage E from its tail and to be pre-stacked such that the sheet can be conveyed with the next paper overlaid thereon. By repeating this operation, two or more sheets can be overlaid and then transferred. The reference numeral 304 denotes a pre-stacking sensor for setting transfer-back timing for pre-stacking a sheet.

When the sheets are guided to the transfer path D and paper alignment and end stapling are performed on the sheets, the sheets guided by the stapling sheet ejection roller 11 to the end-face stapling process tray F are sequentially stacked on the end-face stapling process tray F. In this case, each sheet is aligned along its longitudinal direction (sheet transfer direction) by a hit roller 12 and a tail reference fence 51 along its lateral direction (direction orthogonal to the sheet transfer direction, which is also referred to as "sheet width direction") by the jogger fence 53. After the final sheet of the sheet bundle PB comes until the top paper of the next sheet bundle comes, the end-face stapler S1 that serves as a stapling unit is driven by a stapling signal from a CPU 101 described below to perform a stapling process. The stapled sheet bundle PB is immediately sent to the sheet ejecting roller pair 6 by a release belt 52 (see FIG. 2) having a release claw 52*a* provided thereon so as to protrude and is then ejected to the shift tray 202 in a receiving position.

Figure 2:
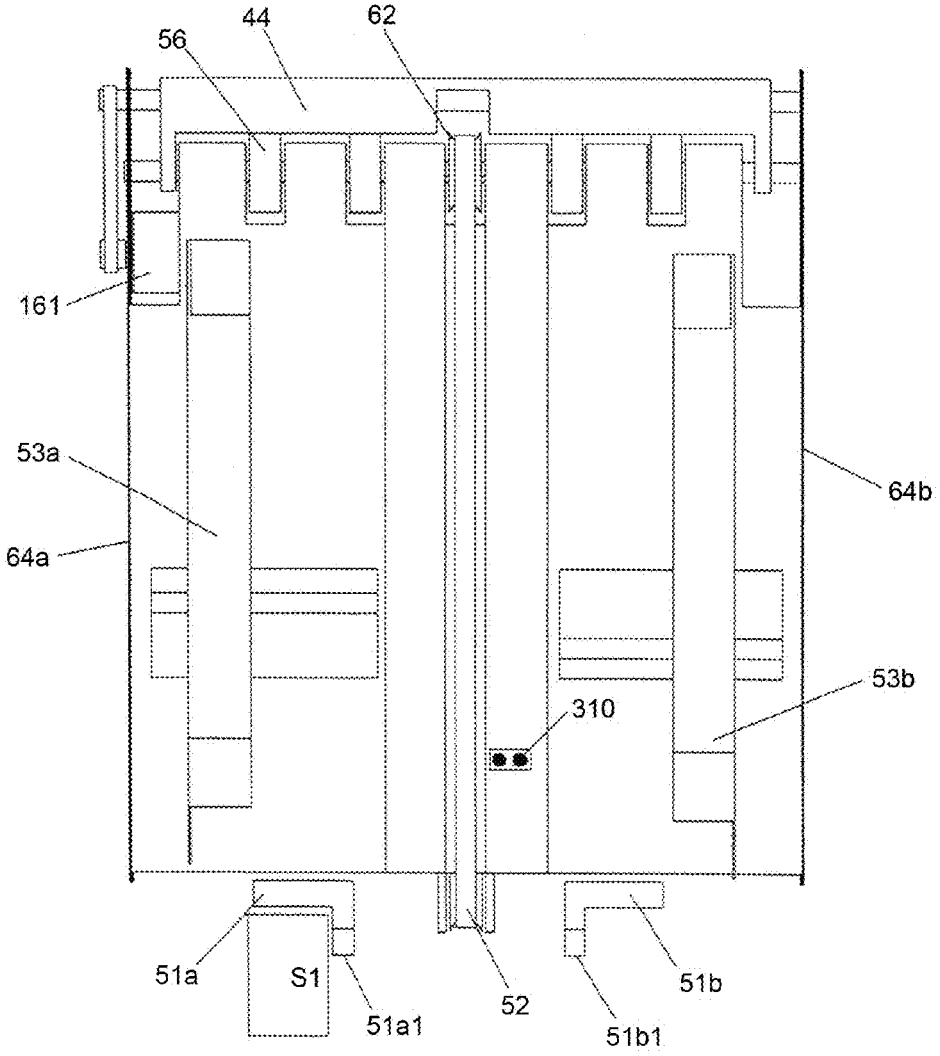
FIG. 2 is a schematic configuration diagram of an end-face stapling process tray that is shown in FIG. 1 and is viewed from the stacking face of the tray.
Figure 4:
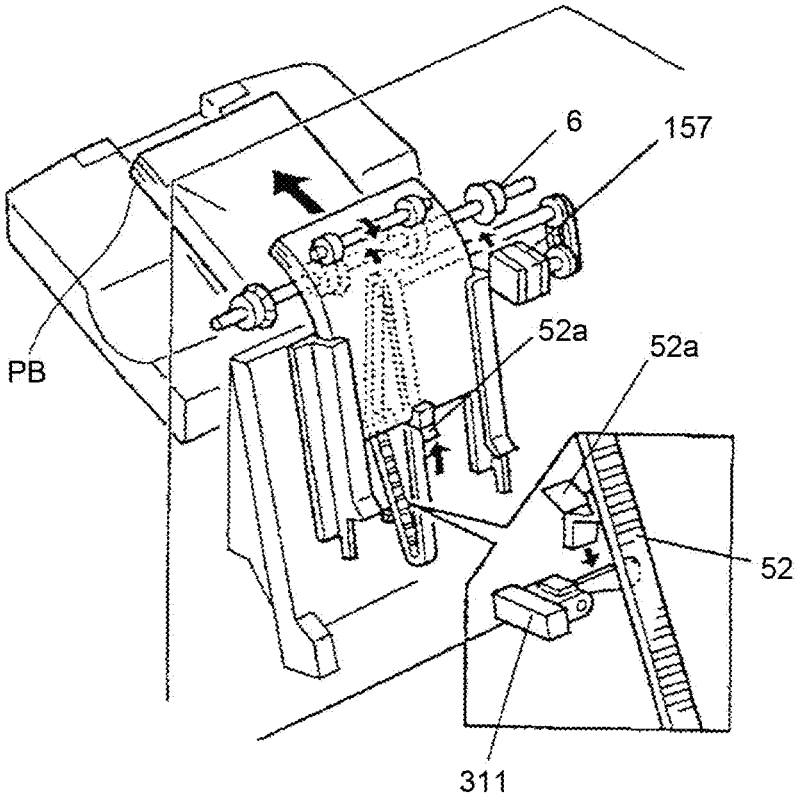
FIG. 4 is a perspective view depicting operations of a release belt shown in FIG. 1.

As shown in FIGS. 2 and 4, the release belt 52 is positioned at the center of alignment in the sheet width direction, extends between pulleys 62, and is driven by a release-belt drive motor 157. Multiple release rollers 56 are arranged symmetrically about the release belt 52, are provided so as to be rotatable about the drive shaft, and function as driven rollers.

A release belt HP sensor 311 detects the home position of the release claw 52*a*. The release belt HP sensor 311 is turned on/off by the release claw 52*a* that is provided to the release belt 52. Two release claws 52*a* are arranged in opposite positions on the outer circumference of the release belt 52 so as to alternately move and transfer the sheet bundle PB that is stored in the end-face stapling process tray F. If necessary, the release belt 52 can be rotated back to align the top end of the sheet bundle PB, which is stored in the end-face stapling process tray F, along the transfer direction by using the back face of the release claw 52*a* opposed to the release claw 52*a* that is stand-by for moving the sheet bundle PB.

The reference numeral 110 shown in FIG. 1 denotes a tail pressing lever that is positioned at a lower end of the tail reference fence 51 such that the tail of the sheet bundle PB stored in the tail reference fence 51 can be pressed. The tail pressing lever 110 reciprocates in a direction approximately orthogonal to the end-face stapling process tray F. Each sheet P stacked on the end-face stapling process tray F is aligned by the hit roller 12 in the longitudinal direction (sheet transfer direction). If the tail of a sheet stacked on the end-face stapling process tray F is curled or has low stiffness, the tail of the sheet tends to buckle and billow due to its weight. Furthermore, an increase in the number of stacked sheets reduces the clearance in the tail reference fence 51 for the following sheets, which tends to deteriorate alignment in the longitudinal direction. The tail pressing mechanism reduces billowing of the sheet tail PT, which allows the sheet P to easily enter the tail reference fence 51. The tail pressing lever 110 directly presses a sheet P or a sheet bundle PB.

The reference numerals 302, 303, 304, 305 and 310 shown in FIG. 1 are sheet detection sensors that detect whether a sheet passes through the position where the sheet detection sensor is provided or whether a sheet(s) is stacked.

FIG. 2 is a schematic configuration diagram of the end-face stapling process tray F viewed from the stacking surface of the tray, i.e., from the left side in FIG. 1. Jogger fences 53*a* and 53*b* align a sheet, which is received from the upstream image forming apparatus PR, in the width direction of the sheet. The sheet is struck on tail reference fences 51*a* and 51*b* (denoted by the reference numeral 51 in FIG. 1) so as to be aligned in the longitudinal direction of the sheet. The tail reference fences 51*a* and 51*b* have stacking faces 51*a* 1 and 51*b* 1 on their inner sides with which the sheet tail make contact and is held, thereby supporting the sheet tail PT at two points. After the aligning operation ends, the end-face stapler S1 performs a stapling process. It can be understood from the perspective view depicting the operation of the release belt shown in FIG. 4 that the release belt 52 is driven counterclockwise by the release-belt drive motor 157, the stapled sheet bundle PB is lifted up by the tail reference fences 51*a* and 51*b* to a given position, then is taken up by the release claw 52*a* provided to the release belt 52, and is ejected from the end-face stapling process tray F. The reference numerals 64*a* and 64*b* denote a front plate and a back plate, respectively. The same operation can be performed for an unstapled bundle that has not been stapled after the alignment process.

Figure 3B:
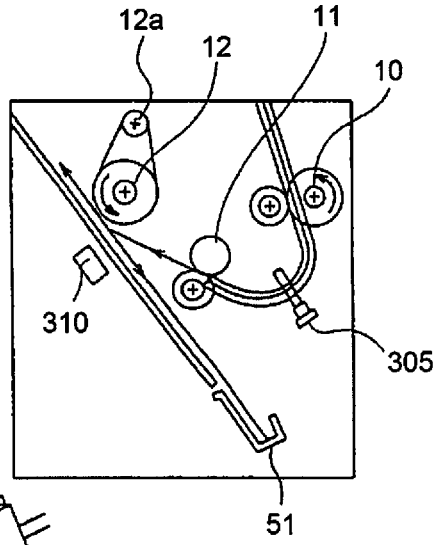
FIG. 3(*a*) is a perspective view of a schematic configuration of the end-face stapling process tray and its attached mechanism, FIG. 3(*b*) is a side view of main section of the schematic configuration of the end-face stapling process tray and its attached mechanism.
Figure 3A:
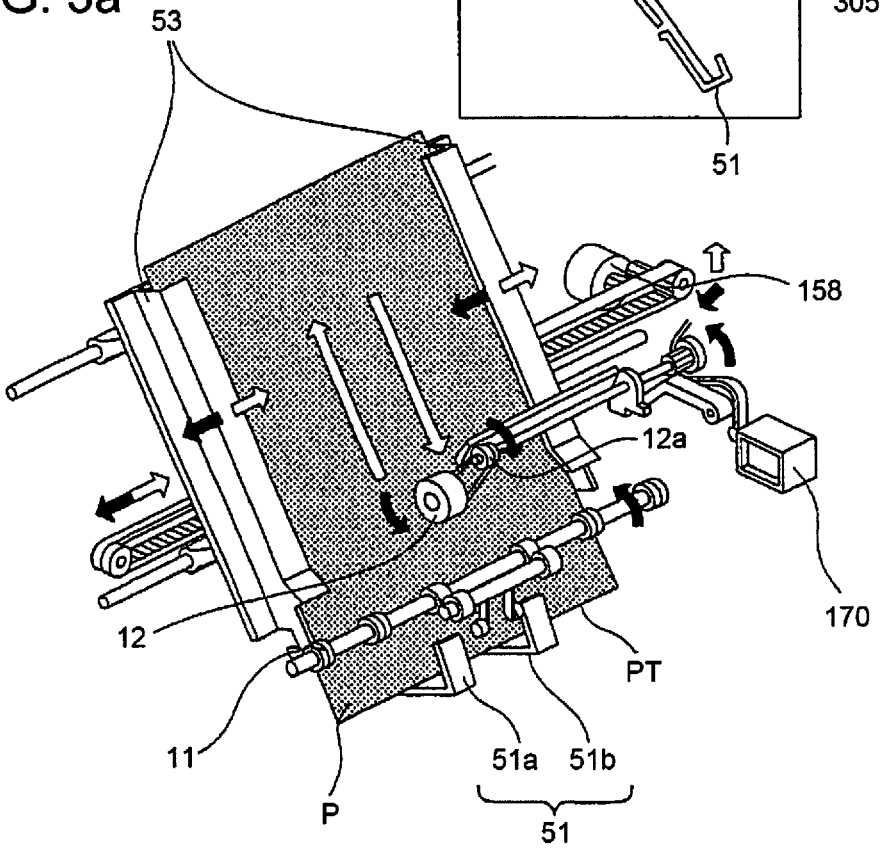

FIG. 3 is a perspective view of a schematic configuration of the end-face stapling process tray F and its attached mechanism. As shown in FIG. 3, the sheet P that is guided by the stapling sheet ejection roller 11 to the end-face stapling process tray F is sequentially stacked on the end-face stapling process tray F. If one sheet P is ejected to the end-face stapling process tray F, the sheet is aligned between the hit roller 12 and the tail reference fence 51 in the longitudinal direction (sheet transfer direction) and is aligned in the width direction (sheet width direction orthogonal to the sheet transfer direction) by the jogger fences 53*a* and 53*b*. The hit roller 12 is swung about a fulcrum 12*a* by a hit SOL 170 and intermittently acts on the sheet, which is sent to the end-face stapling process tray F, such that the sheet tail PT is pushed against the tail reference fence 51. The hit roller 12 rotates in the counterclockwise direction shown in FIG. 3. The jogger fence 53 includes a pair of front and back jogger fences (53*a* and 53*b*) as shown in FIGS. 2 and 3 that are driven by a jogger motor 158, which can rotate forward/back the jogger fences, via a timing belt and that reciprocate so as to be close to/separated from each other in the sheet width direction.

Here, reference is made to FIG. 1. A sheet bundle deflecting mechanism is provided on the downstream side with respect to the back-end stapling process tray F in the sheet transfer direction. A transfer path that sends the sheet bundle PB from the end-face stapling process tray F to the middle stapling process tray G and from the end-face stapling process tray F to the shift tray 202 and a transfer unit that transfers the sheet bundle PB include a transfer mechanism 35 that applies a transfer force to the sheet bundle PB; the release roller 56 that turns the sheet bundle PB; and the guide member 44 that guides the sheet bundle PB to be turned.

Here, detailed structure will be described. The drive force of a drive shaft 37 is transmitted to a roller 36 of the transfer mechanism 35 via the timing belt. The roller 36 and the drive shaft 37 are connected and supported by the arm and the roller 36 can swing about the drive shaft 37 serving as the rotary fulcrum. The roller 36 of the transfer mechanism 35 is swung by a cam 40 that rotates about the rotation shaft and that is driven by a motor (not shown). In the transfer mechanism 35, a driven roller 42 is arranged in a position opposed to the roller 36 and the driven roller 42 and the roller 36 sandwich the sheet bundle PB with a flexible member that press the sheet bundle to apply a transfer force thereto.

The transfer path where the sheet bundle PB is turned from the end-face stapling process tray F to the middle stapling process tray G is formed between the release rollers 56 and the inner face of the guide member 44 on the side opposed to the release rollers 56. The guide member 44 rotates about the fulcrum. The drive force for the rotation is transmitted from a bundle bifurcation drive motor 161 (see FIG. 2). When transferring the sheet bundle PB from the end-face stapling process tray F to the shift tray 202, the guide member 44 rotates about the fulcrum in the clockwise direction shown in FIG. 1 and the clearance between the outer face of the guide member 44 (the face not opposed to the release rollers 56) and the guide plate on the outer side with respect to the guide member 44 functions as the transfer path. When sending the sheet bundle PB from the end-face stapling process tray F to the middle stapling process tray G, the tail of the sheet bundle PB, which has been aligned in the end-face stapling process tray F, is pushed up by the release claw 52*a* and is sandwiched by the roller 36 of the transfer mechanism 35 and the driven roller 42 opposed to the roller 36 so as to be applied with a transfer force. The roller 36 of the transfer mechanism 35 is standby in a position where the roller 36 does not abut on the top of the sheet bundle PB. After the top of the sheet bundle PB passes through, the roller 36 of the transfer mechanism 35 is caused to make contact with the sheet surface so as to apply a transfer force to the sheet. The guide member 44 and the release roller 56 forms a guide of a turning transfer path to transfer the sheet bundle PB to the downstream middle stapling process tray G.

As shown in FIG. 1, the middle stapling process tray G is provided on the downstream side with respect to the sheet bundle deflecting mechanism that includes the transfer mechanism 35, the guide member 44, and the release roller 56. The middle stapling process tray G is provided approximately vertically on the downstream side with respect to the sheet bundle deflecting mechanism. In the middle stapling process tray G, a center-folding mechanism is arranged at the canter, a bundle transfer upper guide plate 92 is arranged above the center-folding mechanism, and a bundle transfer lower guide plate 91 is arranged under the center-folding mechanism.

A bundle transfer upper roller 71 is provided to an upper part of the bundle transfer upper guide plate 92 and a bundle transfer lower roller 72 is provided to a lower part of the bundle transfer upper guide plate 92. Middle stapling upper jogger fences 250*a* are arranged across the rollers 71 and 72 along the side face of the bundle transfer upper guide plate 92 on both sides thereof. Similarly, middle stapling lower jogger fences 250*b* are arranged along the side face of the bundle transfer lower guide plate 91 on both sides thereof and a middle stapler S2 is arranged in the part where the middle stapling lower jogger fences 250*b* are arranged. The middle stapling upper jogger fences 250*a* and the middle stapling lower jogger fences 250*b* are driven by a drive mechanism (not shown) and perform an aligning operation along a direction orthogonal to the sheet transfer direction (sheet width direction). The middle stapler S2 includes a clincher and a driver unit that works as a unit and two units are provided along the sheet width direction with a given interval.

Furthermore, a movable tail reference fence 73 that traverses the bundle transfer lower guide plate 91 is arranged. The movable tail reference fence 73 can be moved in the sheet transfer direction (vertical direction in FIG. 1) by a moving mechanism that includes the timing belt and the drive mechanism for the timing belt. As shown in FIG. 1, the drive mechanism includes a drive pulley and a driven puller between which the timing belt extends; and a stepping motor that drives the drive pulley. Similarly, a tail hit claw 251 and a drive mechanism for the tail hit claw 251 are provided at the upper end of the bundle transfer upper guide plate 92. A timing belt 252 and the drive mechanism (not shown) cause the tail hit claw 251 to reciprocate along the direction in which the tail hit claw 251 separates from the sheet bundle deflecting mechanism and the direction in which the tail hit claw 251 pushes the tail of the sheet bundle PB (a part serving as the tail when the sheet bundle is guided).

The center-folding mechanism is provided approximately at the center of the middle stapling process tray G. The center-folding mechanism includes the folding plate 74, the folding roller 81, and the transfer path H for transferring the folded sheet bundle PB. Regarding FIG. 1, the reference numeral 326 denotes a home position sensor for detecting the home position of the tail hit claw 251, the reference numeral 323 denotes a folded-part passing-through sensor for detecting a folded sheet, the reference numeral 321 denotes a bundle detection sensor that detects that the sheet bundle PB has reached the center-folding position, and the reference numeral 322 denotes a movable tail reference fence home position sensor that detects the home position of the movable tail reference fence 73.

In the embodiment, a detection lever 511 that detects the height of the stacked center-folded sheet bundle PB is provided to the lower tray 203 such that the detection lever 511 can swing about a fulcrum 511*a*. A paper-surface sensor 515 detects the angle of the detection lever 511 and operations for lifting up/down the lower tray 203 and for detecting over-flow are performed.

Figures 5A, 5B:
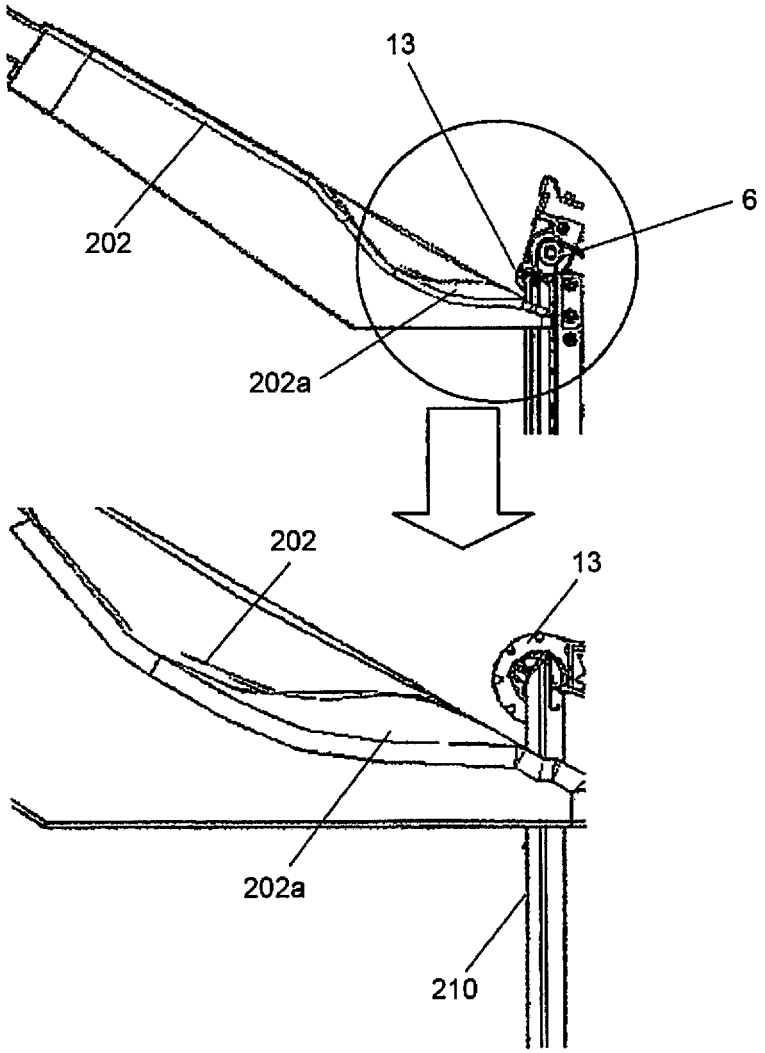
FIGS. 5(*a*) and 5(*b*) are front views of main section of the shift tray shown in FIG. 1 in a stand-by state.

FIG. 5 is a front view of main section of a sheet ejecting unit of the shift tray 202. FIG. 5(*a*) depicts a stand-by state for ejection of sheets and FIG. 5(*b*) is an enlarged view of the circled part shown in FIG. 5(*a*). Sheets are conveyed toward the shift tray 202 via the sheet ejecting roller pair 6

(6*a* and 6*b*) as described above and are sorted on the shift tray 202 particularly by, as described above, the sheet ejecting roller pair 6 (6*a* and 6*b*), the sending-back roller 13, the shift tray 202, the shift mechanism, and the shift tray lifting up/down mechanism.

Figure 6:
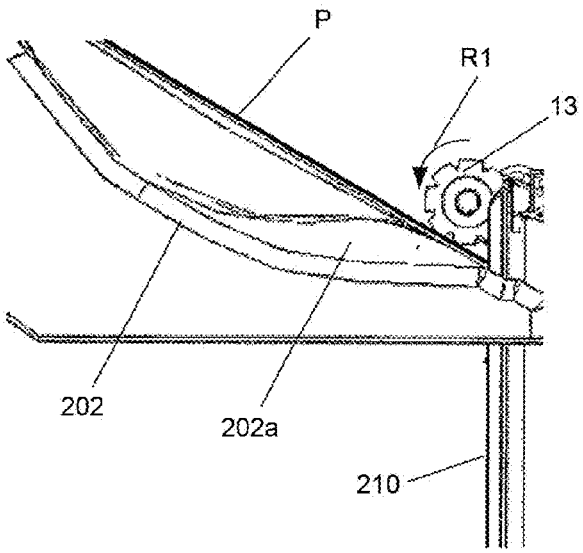
FIG. 6 is a diagram depicting an aligning operation in a transfer direction on a shift tray.

FIG. 6 is a diagram depicting an aligning operation in the transfer direction. The aligning operation is performed after the sheet P is ejected in a way that the sending-back roller 13 makes contact with the sheet P while rotating in the direction in which the sheet P is sent back toward an end fence 210 (direction indicated by the arrow R1) to positively send back the sheet P toward the end fence 210. Although it is not shown in FIG. 6, the sending-back roller 13 is driven by a sending-back roller drive motor 223, which will be described later, with a drive force that is transmitted by a timing belt 13*a* (see FIG. 12).

Figure 7:
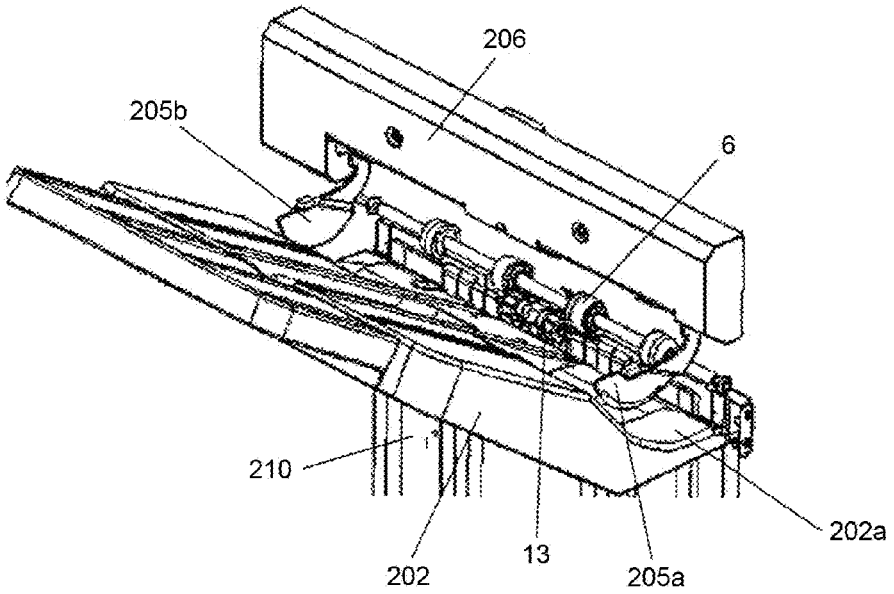
FIG. 7 is a perspective view of a sheet ejecting unit that includes the shift tray and sheet ejecting rollers.

FIG. 7 is a perspective view of a sheet ejecting unit that includes the shift tray and the sheet ejecting rollers. As shown in FIG. 7, a pair of joggers 205*a* and 205*b* that aligns the sheet P in its width direction on the shift tray 202 is provided. The joggers 205*a* and 205*b* are movable by a jogger drive mechanism 206 along the width direction of the sheet P. The jogger drive mechanism 206 has a known structure. The drive mechanism does not directly relate to the invention and thus detailed descriptions thereof will be omitted, but its operation will be described simply here with reference to FIGS. 9 and 10. The reference numeral 202*a* shown in FIG. 5 etc. denotes a clearance (concave portion) that allows the joggers 205*a* and 205*b* to move.

Figure 8:
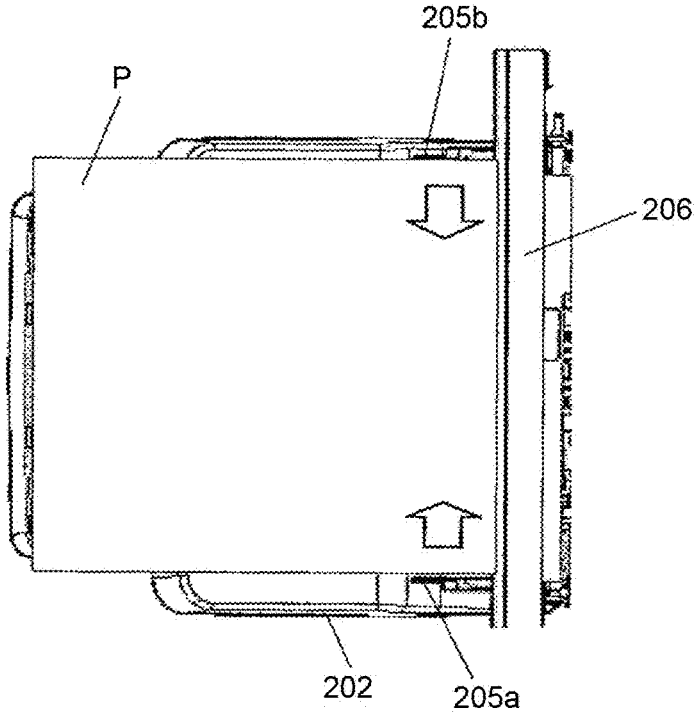
FIG. 8 is a diagram depicting an aligning operation in a sheet direction on the shift tray.

FIG. 8 is a diagram depicting an operation for alignment in the sheet width direction on the shift tray 202. After a sheet is ejected, the front jogger 205*a* and the back jogger 205*b* align the sheet P from the front side and the back side in the width direction of the sheet P.

Figure 9:
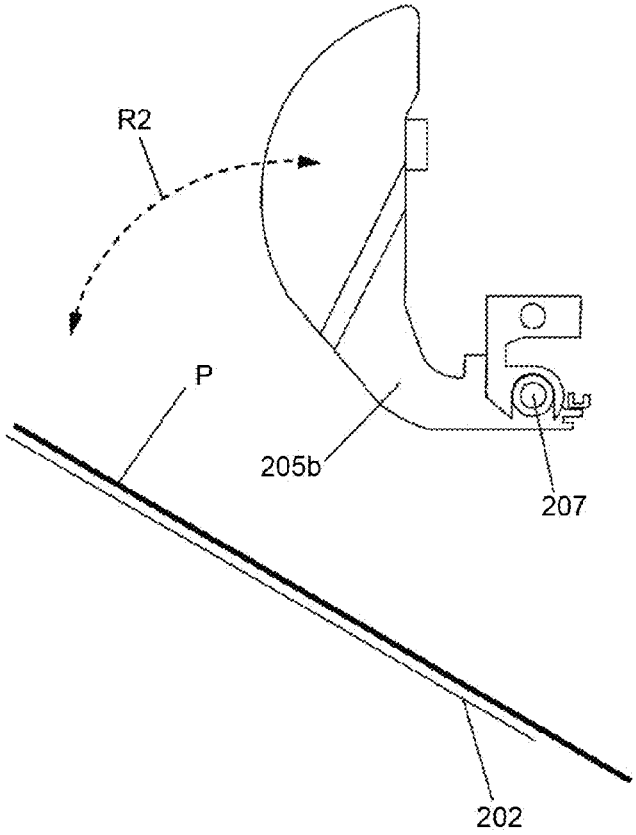
FIG. 9 is a diagram depicting operations of joggers, viewed from the front side, in a withdrawn position.
Figure 10:
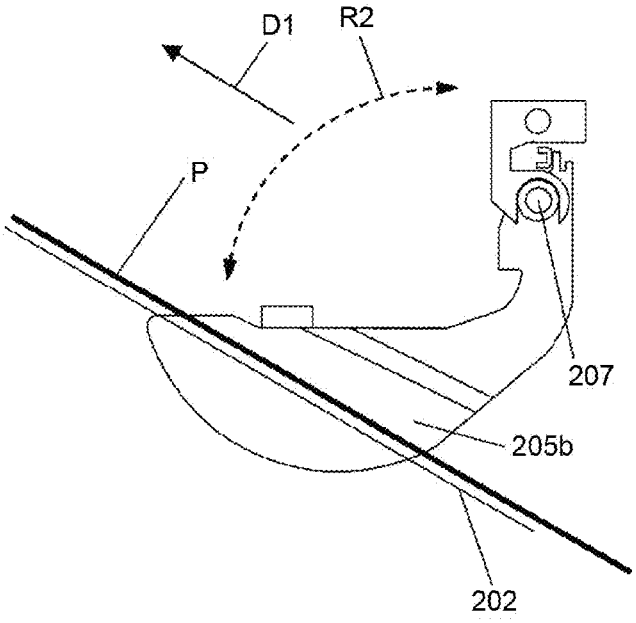
FIG. 10 is a diagram depicting operations of the joggers, viewed from the front side, in a sheet aligning position.

FIGS. 9 and 10 are diagrams depicting operations of the joggers 205*a* and 205*b* viewed from the front side. The joggers 205*a* and 205*b* are shift aligning joggers that are provided at the frond and back of the shift tray 202 and that are rotatable (in the direction denoted by the arrow R2) about a rotation shaft 207 within a pre-set angle. In a normal ejection where the aligning operation is not performed, the joggers 205*a* and 205*b* are in an upper withdrawn position as shown in FIG. 9. When aligning a sheet that is ejected onto the shift tray 202, the joggers 205*a* and 205*b* are in a sheet guiding position. The joggers 205*a* and 205*b* are moved to the withdrawn position and the sheet guiding position by rotating the rotation shaft 207 by using a drive motor (not shown).

The joggers 205*a* and 205*b* in the initial position shown in FIG. 10 are apart from the end face of the sheet by a predetermined distance. When performing the sheet aligning operation, the joggers 205*a* and 205*b* make contact with the end face of the ejected sheet P from the front and back sides, respectively, and move in the directions in which the joggers 205*a* and 205*b* come close to each other. When a shift aligning operation is performed, the joggers 205*a* and 205*b* move to the withdrawn position shown in FIG. 9 and the shift tray 202 shifts. After the shifting, the joggers 205*a* and 205*b* return to the sheet guiding position shown in FIG. 10 to perform the aligning operation again. The shift aligning operation is performed in a way that the joggers 205*a* and 205*b* move in the direction orthogonal to the direction D1, in which the sheet P is ejected, and push the sheet P while making contact with the end face of the sheet P as described above.

Figure 11:
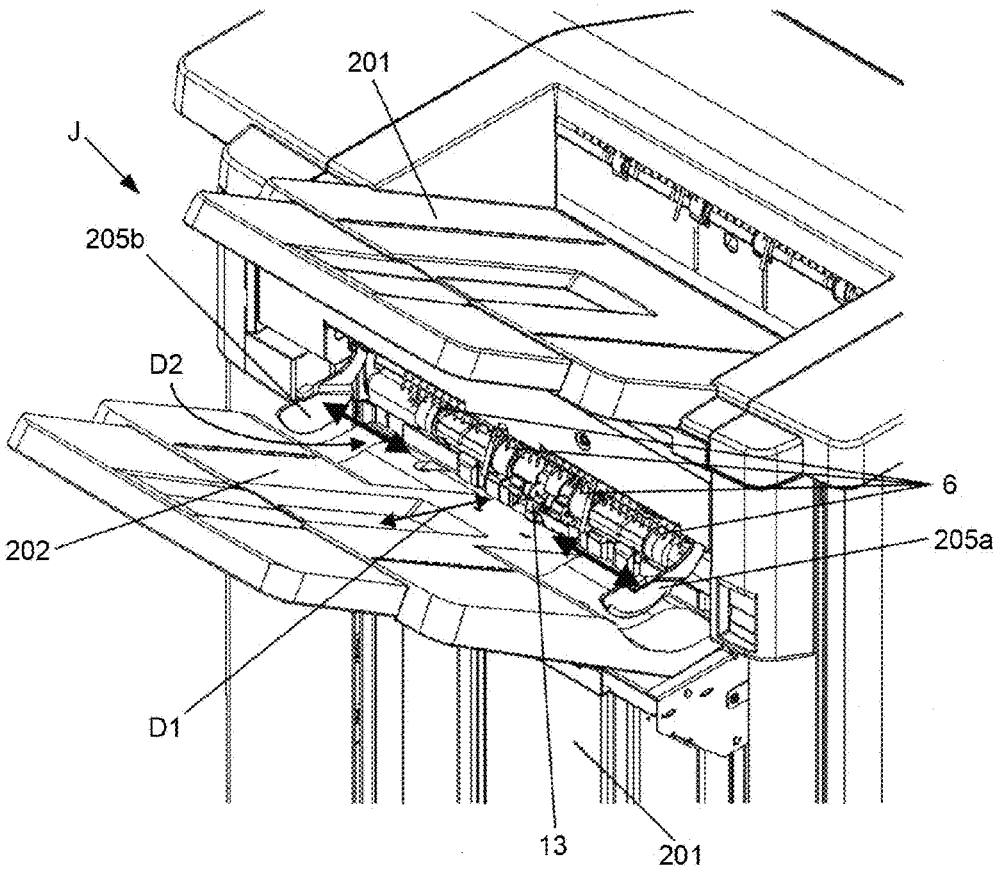
FIG. 11 is a perspective view of the main section of a sheet post processing device depicting the sheet ejecting device.

FIG. 11 is a perspective view of a sheet ejecting device J that includes the shift tray 202, the joggers 205*a* and 205*b*, and the sheet ejecting roller pair 6. FIG. 10 covers, in addition to the perspective view of FIG. 7, the configuration around the shift tray 202, i.e., the upper tray (proof tray) 201 and the end fence 210. As shown in FIG. 11, the joggers 205*a* and 205*b* reciprocate in the direction orthogonal to the sheet ejection direction D1 (the direction denoted by the arrow D2).

Figure 12:
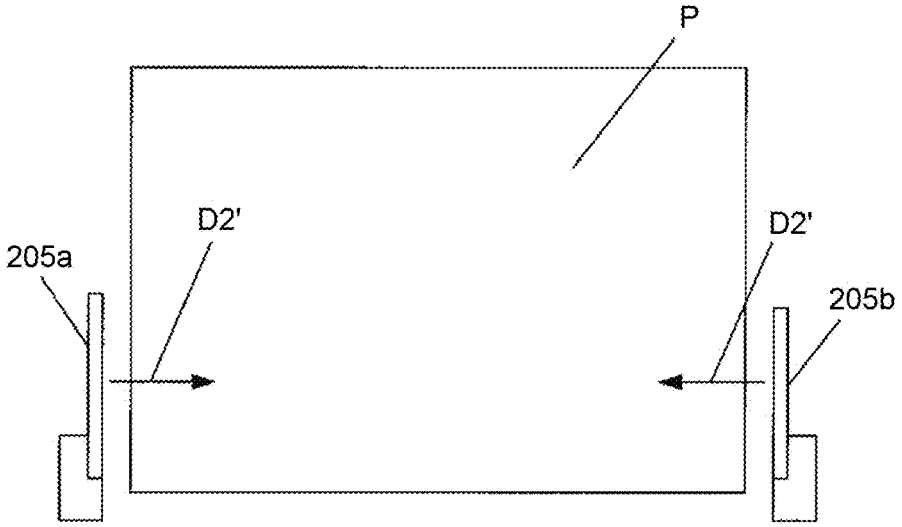
FIG. 12 is a diagram depicting a sheet aligning operation of the joggers, viewed from above, in a stand-by position.
Figure 13:
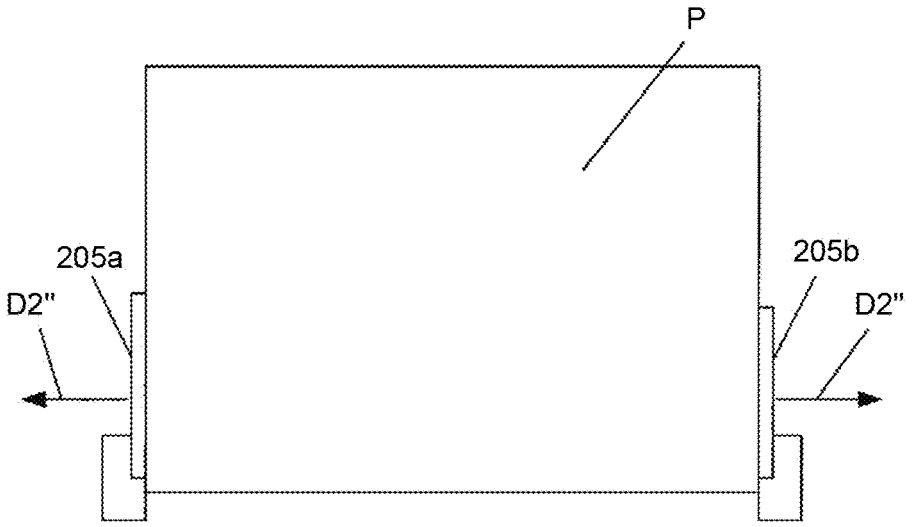
FIG. 13 is a diagram depicting the sheet aligning operation of the joggers, viewed from above, in the aligning position.

In the normal operation where the shifting operation is not performed, the joggers 205*a* and 205*b* come close to the sheet P having a width (length orthogonal to the sheet ejection direction), which is ejected to the shift tray 202, with given intervals each between each of the joggers and the sheet P. By repeating the operation for alignment in millimeters corresponding to the intervals, the joggers 205*a* and 205*b* align the end faces of the sheet. FIGS. 12 and 13 are diagrams depicting the sheet aligning operation and show the shift tray 202 viewed from above. FIG. 12 shows the joggers 205*a* and 205*b* in the stand-by position. FIG. 13 shows the joggers 205*a* and 205*b* in the position where they make contact with the sheet P and align the end faces of the sheet. The aligning operation is performed by repeating, every time when a sheet P is ejected to the shift tray 202, moving from the position shown in FIG. 12 in the direction denoted by the arrow D2' in order to align the ends of the sheet and then moving back from the position shown in FIG. 13 in the direction denoted by the arrow D2" to the stand-by position.

Figure 14:
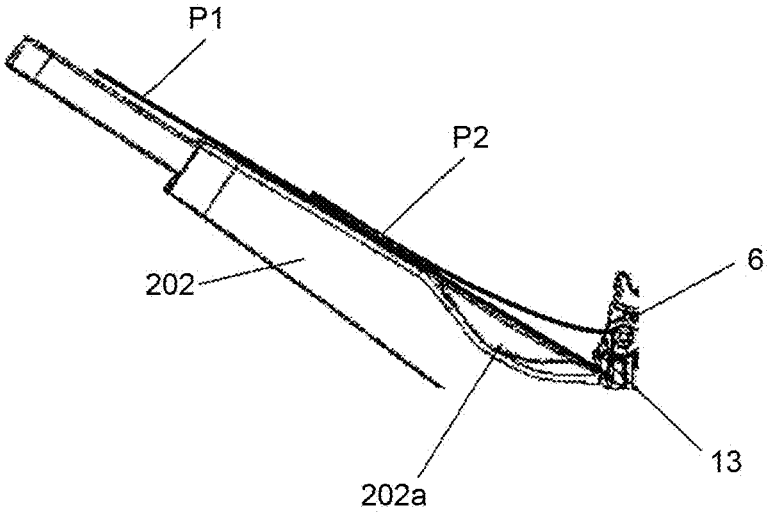
FIG. 14 is a diagram depicting a following sheet being ejected while the preceding sheet is being stacked on the shift tray.
Figure 15:
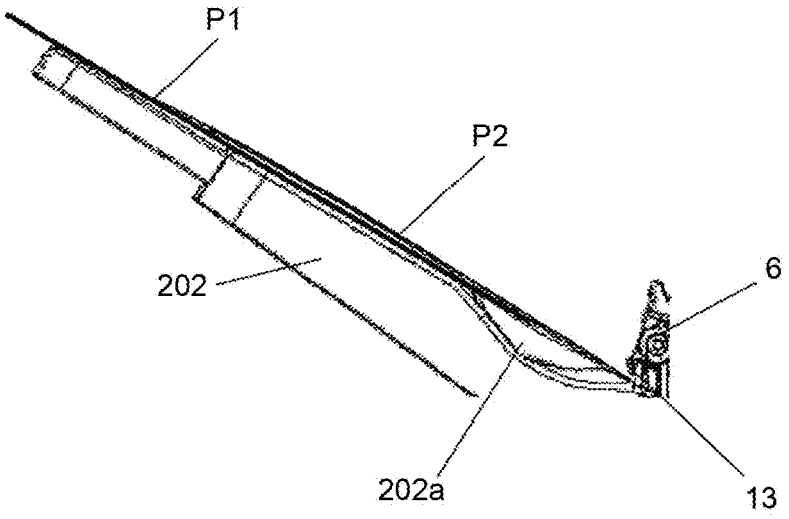
FIG. 15 is a diagram depicting that coherence between sheets in the state shown in FIG. 9 is caused due to their close contact and the following sheet pushes out the preceding sheet.

However, if the sheets P have high smoothness like that of coated paper and when, as shown in FIG. 14, the following sheet P2 is ejected while the preceding sheet P1 is being stacked on the shift tray 202, coherence between the sheets is caused due to their close contact and, as shown in FIG. 15, the following sheet P2 that is making contact with the preceding sheet P1 pushes out the preceding sheet P1. If, as described above, the preceding sheet P1 is pushed out or the following sheet P2 coheres to the stacked sheets PB on the shift tray 202, the joggers 205*a* and 205*b* may not be able to align the sheet in the width direction due to the coherence.

In the embodiment, in order to prevent the preceding sheet P1 from being pushed out, the following sheet P2 is prevented from cohering to the preceding sheet P1 by, when the following sheet P2 is ejected, blowing a wind to the part between the preceding sheet P1 and the following sheet P2.

Figure 16:
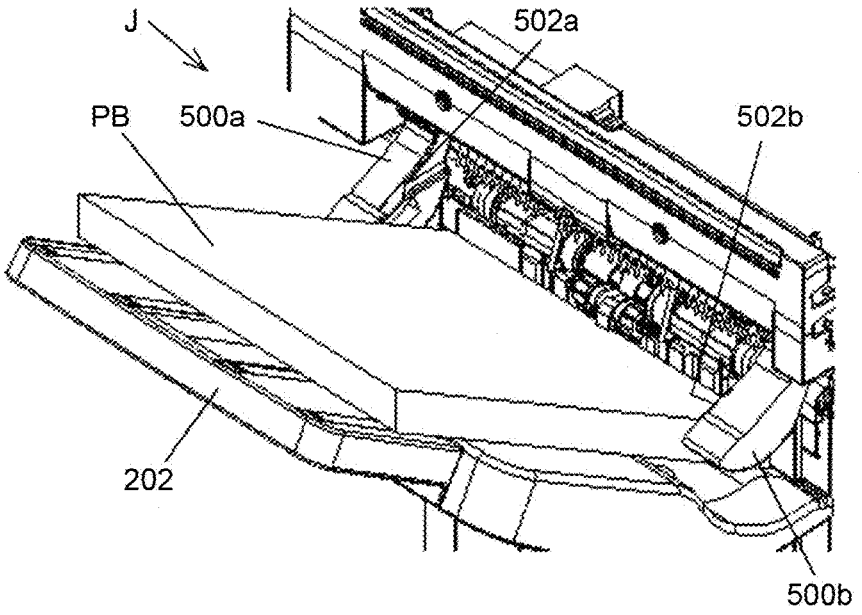
FIG. 16 is a perspective view of a configuration of the sheet ejecting unit that includes a blowing function.
Figure 17:
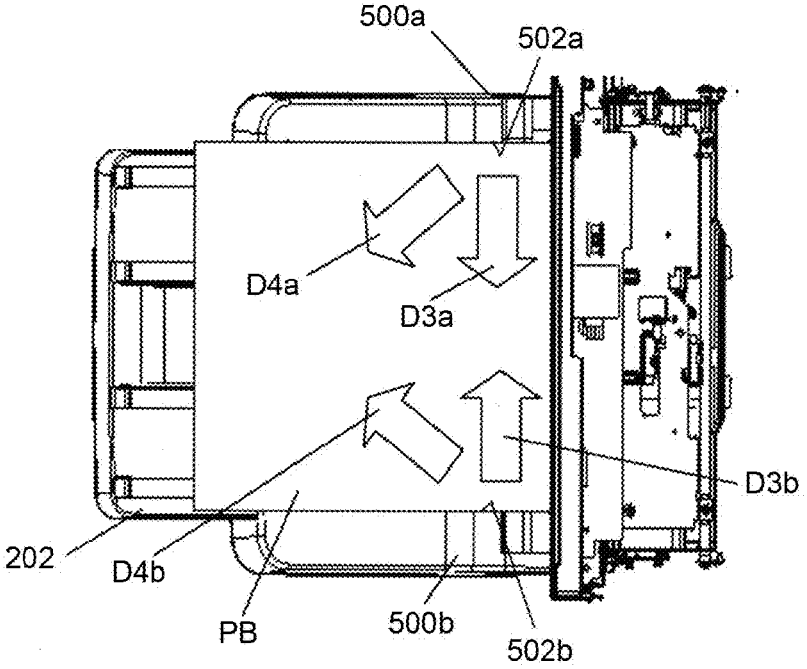
FIG. 17 is a plane view of the sheet ejecting unit shown in FIG. 16.
Figure 18:
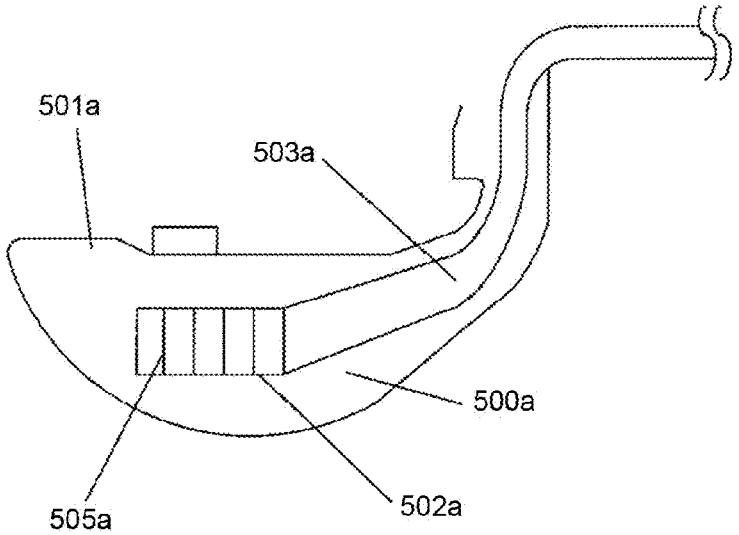
FIG. 18 is a longitudinal-direction cross-sectional view of the back jogger that includes a blowing device.

FIG. 16 is a perspective view of a configuration of the sheet ejecting unit that includes a blowing function, FIG. 17 is a plane view of FIG. 16, and FIG. 18 is a longitudinal-direction cross-sectional view of the back jogger that includes a blowing device.

The sheet ejecting unit shown in FIG. 16 according to the embodiment includes, instead of the joggers 205*a* and 205*b* of the sheet ejecting device J shown in FIGS. 7 and 11, joggers 500*a* and 500*b* shown in FIG. 18 each including a blowing device. As shown in FIG. 18, the joggers 500*a* and 500*b* have blowing ports 502*a* and 502*b* each formed at the center of a sheet aligning face 501*a* that is provided on the inner side of the jogger and that makes contact with the end face of the sheet. The blowing port 502*a* is connected to a fan motor 504*a* that is arranged outside the jogger 500*a* via a duct 503*a* in the jogger 500*a*. The fan motor 504*a* drives a fan (not shown) in order to rotate the fan to blow an amount of wind corresponding to the rotation speed of the fan from the blowing port 502*a* via the duct 503*a*. The duct 503*a* is configured of, for example, a flexible hose-like component and can follow the movement of the joggers 500*a* and 500*b* in the sheet width direction.

The blowing port 502*a* is provided with a louver 505*a* and an angle changing mechanism (not shown) for the louver

Figure 19:
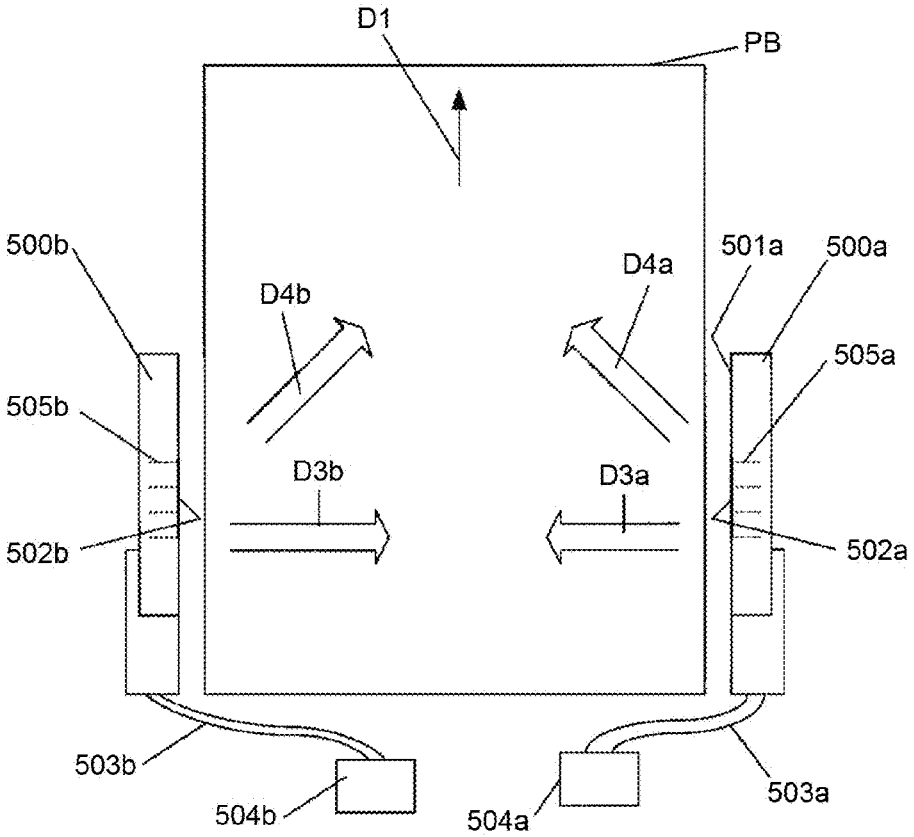
FIG. 19 is a plane view depicting a blowing direction.

505*a*. As shown in FIG. 19 that is a plane view depicting a blowing direction, the louver 505*a* can set the direction in which a wind is blown from the blowing port 502*a* to any desired direction, for example, between the direction denoted by the arrow D3*a* (D3*b*) orthogonal to the sheet transfer direction and the direction toward the downstream side in the pre-set angle sheet transfer direction (denoted by the arrow D4*a* (D4*b*)). The blowing direction can be changed in accordance with the operation for ejecting the sheet P. In this case, even if the positions of the sheet P and the positions of the blowing ports 502*a* and 502*b* move relatively, a wind can be blown to the center of the sheet P. Accordingly, an air layer having an even thickness is formed under the sheet P, which effectively reduces the coherence between the sheets due to their close contact.

FIG. 18 shows the back jogger 500*a*. The front jogger 500*b* shown in FIG. 19 has the same configuration as that of the back jogger 500*a*. The front parts of the device are distinguished from the back parts by using the suffix, b. In the embodiment, the blowing device includes fans (not shown), the fan motors 504*a* and 504*b*, the ducts 503*a* and 503*b*, the blowing ports 502*a* and 502*b*, and the louvers 505*a* and 505*b*. The CPU 101 described below controls the amount of wind and the direction in which the wind is blown.

The structure of the joggers 500*a* and 500*b* makes it possible to perform the aligning operation in the width direction while the fans blown winds from the side faces of the sheet. The louvers 505*a* and 505*b* are used to blow winds in the direction denoted by the arrows D3*a* and D3*b* that are orthogonal to the sheet ejecting direction D1 and, accordingly, an air layer is formed between the stacked sheet bundle PB and the sheet P that is ejected, thereby separating the sheets P. Alternatively, a wind can be blown in directions (denoted by the arrows D4*a* and D4*b*) oblique to the sheet ejecting direction D1 in order to reduce coherence between the stacked sheet bundle PB and the ejected sheet P. By forming an air layer between the bottom surface of the ejected sheet P and the top surface of the stacked sheet bundle PB, the contacting sheets can be separated from each other by the air, which allows the joggers 500*a* and 500*b* to perform the aligning operation or improves the alignment accuracy.

Winds are sent from the fan motors 504*a* and 504*b* to the joggers 500*a* and 500*b* via the flexible hose-like ducts 503*a* and 503*b* and are blown from the blowing ports 502*a* and 502*b* of the joggers 500*a* and 500*b*. The joggers 500*a* and 500*b* are symmetrical and thus winds are blown symmetrically about the center of the transfer. In the example shown in FIG. 19, when the joggers 500*a* and 500*b* move in accordance with the sheet size, the hose-like ducts extend and contract as described above. Alternatively, the fan motors 504*a* and 504*b* may be configured to move in conjunction with the joggers 500*a* and 500*b*. The arrows shown in FIG. 17 are the same as the arrows D3*a*, D3*b*, D4*a* and D4*b* shown in FIG. 19.

Figure 20:
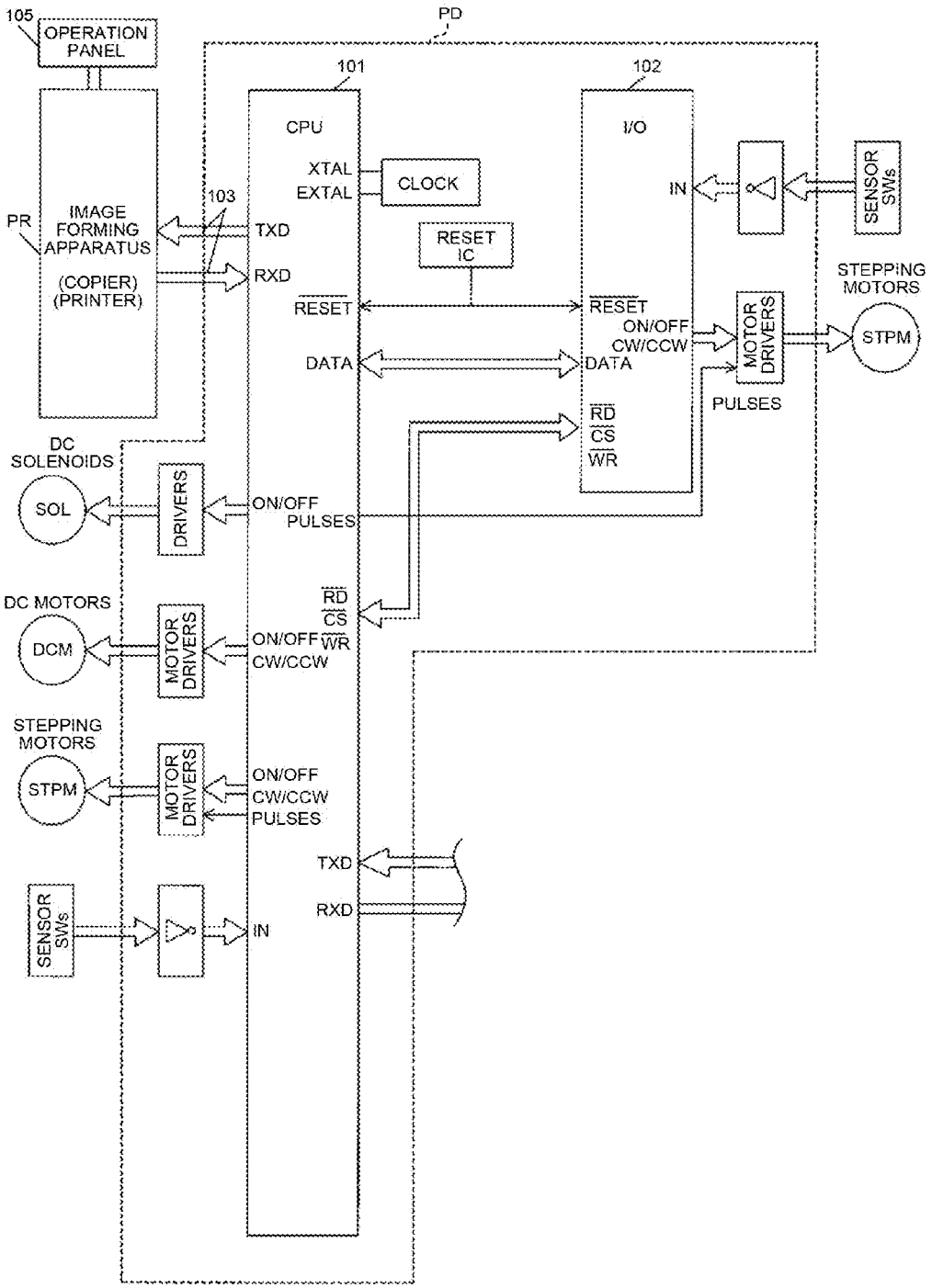
FIG. 20 is a block diagram of a control configuration of an image forming system that includes the sheet post processing device and the image forming apparatus.

FIG. 20 is a block diagram of a control configuration of the image forming system that includes the sheet post processing device PD and the image forming apparatus PR. The sheet post processing device PD includes a control circuit on which the CPU 101 and a microcomputer that includes an I/O interface 102 are mounted. Signals from the CPU of the image forming apparatus PR, from each switch etc. of the operation panel 105, and from each sensor (not shown) are input to the CPU 101 via a communication interface 103. The CPU 101 performs given controls according to the input signals.

The CPU 101 then drives and controls the solenoids and motors via the drivers and the motor drivers to acquire information from the sensors in the device via the interface. Sensor information is acquired from the sensors by driving and controlling the motors according to the component to be controlled and sensors by using the motor drivers via the I/O interface 102. The CPU 101 performs the control by reading the program codes that are stored in a ROM (not shown), by loading the program codes in a RAM (not shown), and by using the RAM as a work area and a data buffer according to the program that is defined by the program codes.

Figure 21:
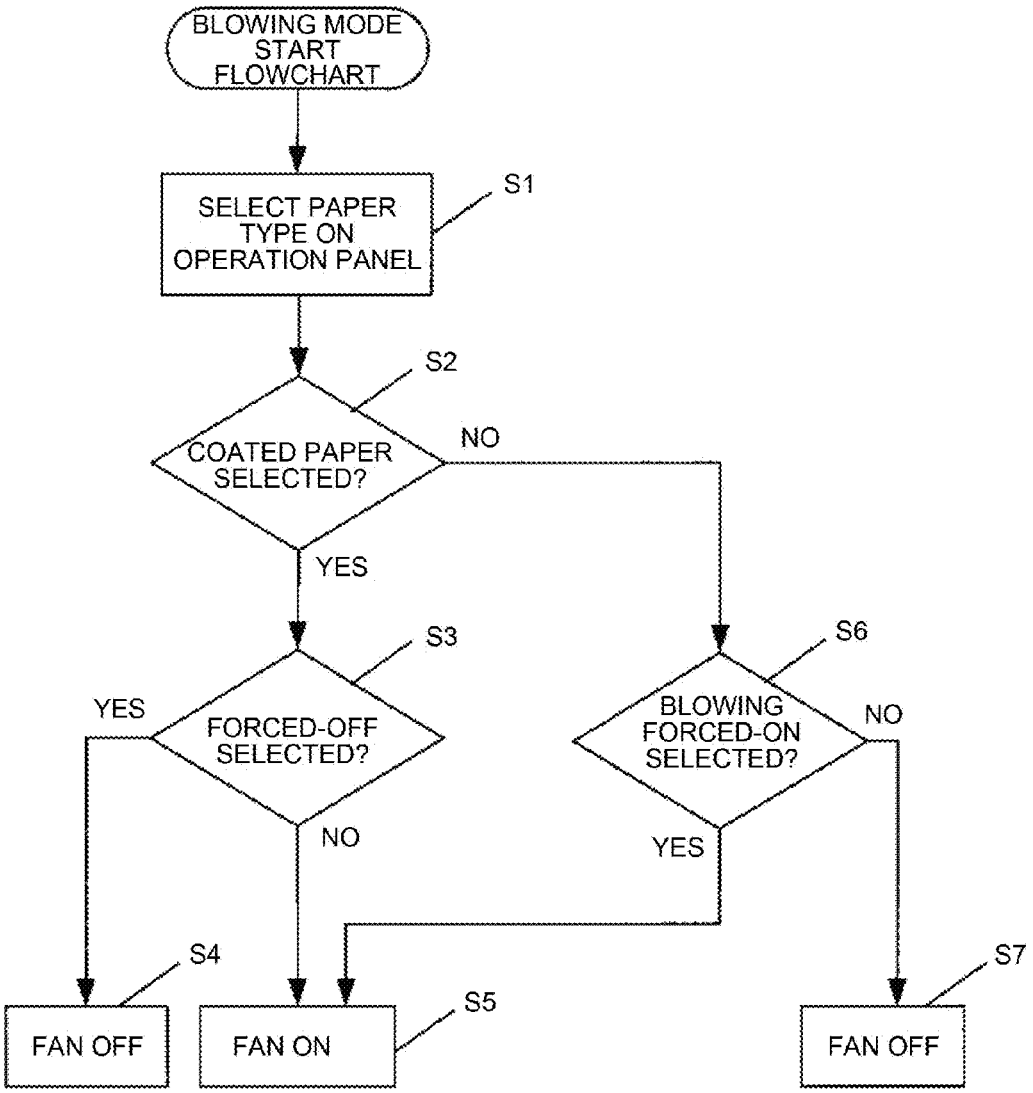
FIG. 21 is a flowchart of a basic procedure of a CPU in blowing mode.

FIG. 21 is a flowchart of a basic procedure of the CPU in a blowing mode according to the embodiment. The CPU 101 performs the procedure.

When the user selects coated paper on the operation panel 105 in the initial setting, the blowing mode is on in order to prevent coherence between sheets due to close contact between the sheets. However, if forced-off is selected, blowing is not performed even for coated paper. For normal paper, blowing is not performed in the initial setting but it can be performed by selecting forced-on.

When the processes shown in FIG. 21 are started, the user selects the paper type on the operation panel 105 (step S1). When coated paper is selected, the fan motors 504*a* and 504*b* are turned on in the initial setting in order to rotate the fans so that blowing is started (NO at step S3, step S5). When forced-off for the fan motors 504*a* and 504*b* is selected (YES at step S3), the fan motors 504*a* and 504*b* are turned off and blowing is not performed (step S4).

In contrast, when coated paper is not selected, i.e., normal paper is selected, because the fan motors 504*a* and 504*b* are off (NO at step S6), the fan motors 504*a* and 504*b* are not driven and thus blowing is not performed (step S7). However, when blowing forced-on is selected (YES at step S6), the fan motors 504*a* and 504*b* are turned on so that the fans rotate and blowing is started (step S5).

Figure 22:
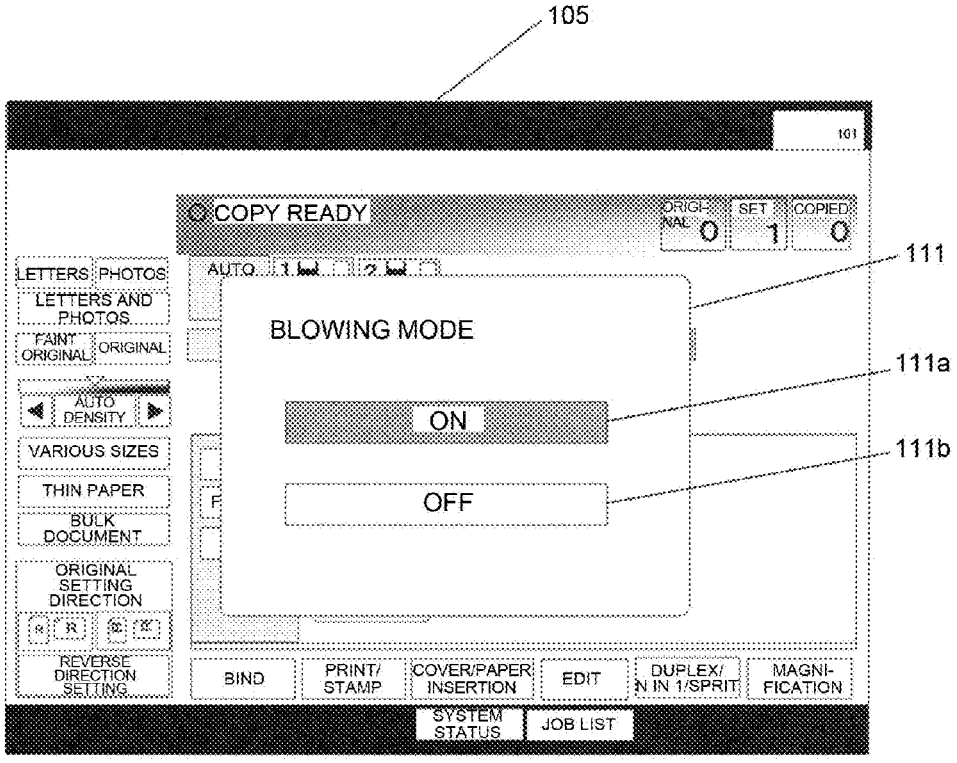
FIG. 22 is a diagram of an example of a selection screen of an operation panel in the blowing mode.

FIG. 22 is a front view of the operation screen 111 of the operation panel 105 of the image forming apparatus PR in the blowing mode. On this screen, "ON" is selected and highlighted. This display is shown after coated paper is selected at step S2. When coated paper is selected, the display of blowing "ON" 111*a* is made. If this state remains, steps S3 to S5 are performed. If "OFF" 111*b* is selected, the fans are turned off at step S4.

In contrast, when coated paper is not selected at step S2, the fan motors 504*a* and 504*b* are off in the initial setting. When blowing forced-on is selected, blowing "ON" 111*a* shown in FIG. 22 is displayed and the fans are turned on at step S5.

As described above, the embodiment leads to the following effects.

1) Because the device includes the sheet ejecting roller pair 6; the shift tray 202 on which sheets P that are ejected by the sheet ejecting roller pair 6 are stacked; the joggers 500*a* and 500*b* that perform alignment in the direction D2 orthogonal to the direction D1 in which the sheets P are ejected; and the blowing device (the blowing ports 502*a* and 502*b*, the ducts 503*a* and 503*b*, the fan motors 504*a* and 504*b*, and the fans), winds can be blown toward both ends of sheets that have high surface smoothness and thus easily cohere to one another. Accordingly, coherence between the sheets due to their close contact can be prevented or reduced, which makes it possible to prevent misalignment in the width direction and have good accuracy in alignment.

2) Because an air layer is formed under the ejected sheet P by blowing winds, the effect 1) can be obtained.

3) Because the blowing device includes the blowing ports 502*a* and 502*b* that are formed on the sheet aligning faces 501*a* and 501*b* of the joggers 500*a* and 500*b*; and the ducts 503*a* and 503*b* that guide winds from the fans to the blowing ports 502*a* and 502*b*, air can be blown to a part under the sheet P from the end faces of the sheet P (from the direction orthogonal to the sheet ejection direction) in order to form an air layer.

4) Because the ducts 503*a* and 503*b* are flexible in accordance with the movement of the joggers 500*a* and 500*b*, air can be blown following the reciprocation during the aligning operation in accordance with the sheet size.

5) Because the blowing ports 502*a* and 502*b* are provided with the louvers 505*a* and 505*b* that change the blowing direction to a desired direction, the blowing direction can be changed according to the sheet information and thus an air layer can be formed.

6) Because the blowing direction can be set to the directions (denoted by the arrows D3*a* and D3*b*) orthogonal to the direction D1 in which the sheet P is ejected and the directions (D4*a* and D4*b*) oblique to the sheet ejecting direction D1, the blowing direction can be changed according to the sheet transfer state in order to form an air layer having an even thickness.

7) Because blowing is performed in conjunction with the aligning operation performed by the joggers 500*a* and 500*b*, aligning operation can be performed on sheets that do not make contact with each other, which leads to good accuracy in alignment.

8) Because whether to perform blowing is set according to the information on the type of sheets to be ejected, blowing can be controlled separately for coated sheets that easily cohere to one other and normal sheets.

The sheets in claims correspond to the symbol P; the sheet ejecting unit corresponds to the paper ejecting roller pair 6; the sheet ejecting direction corresponds to the reference numeral D1; the direction orthogonal to the sheet ejecting direction corresponds to the reference numeral D2; the aligning unit corresponds to the joggers 500*a* and 500*b*; the blowing unit corresponds to the blowing device (the fans (not shown), the fan motors 504*a* and 504*b*, the ducts 503*a* and 503*b*, the blowing ports 502*a* and 502*b*, and the louvers 505*a* and 505*b*); the sheet ejecting device corresponds to the reference symbol J, the aligning faces corresponds to the reference numerals 501*a* and 501*b*; the blowing port correspond to the reference numerals 502*a* and 502*b*; a wind guiding path corresponds to the ducts 503*a* and 503*b*; the louver corresponds to the reference numerals 505*a* and 505*b*; the blowing direction corresponds to the reference numerals D3*a*, D3*b*, D4*a*, and D4*b*; the setting unit corresponds to the CPU 101 and the operation panel 105; and the image forming system corresponds to the system including: the sheet post processing device PD including the sheet ejecting device J; and the image forming apparatus PR.

According to an aspect of the invention, coherence between ejected sheets can be prevented and good accuracy in alignment of the stacked sheets can be achieved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet ejecting device comprising:

a sheet ejecting unit configured to eject a sheet;

a stacking unit on which the sheet that is ejected by the ejecting unit is stacked;

an aligning unit configured to move in a direction perpendicular to the sheet transfer direction;

a blowing unit provided with the aligning unit and configured to blow air toward the ejected sheet; and a louver configured to be provided to the blowing unit and change the direction in which the air is blown to a desired direction, wherein the blowing unit includes a blowing port formed on a sheet aligning face of the aligning unit, and wherein the blowing unit includes an air guiding path configured to guide the air from a source of air.

2. The sheet ejecting device according to claim 1, further comprising a setting unit configured to set whether to blow the air in accordance with information on the type of sheet to be ejected.

3. The sheet ejecting device according to claim 1, wherein the direction in which the air is blown includes the direction orthogonal to the direction in which the sheet is ejected and a direction oblique to the direction in which the sheet is ejected.

4. The sheet ejecting device according to claim 1, wherein the blown air forms an air layer under the ejected sheet.

5. The sheet ejecting device according to claim 1, wherein the blowing is performed in conjunction with the alignment performed by the aligning unit.

6. The sheet ejecting device according to claim 1, wherein the air guiding path is flexible according to the movement of the aligning unit.

7. A sheet ejecting device comprising:

a sheet ejecting unit configured to eject a sheet;

a stacking unit on which the sheet that is ejected by the ejecting unit is stacked;

an aligning unit configured to move in a direction perpendicular to the sheet transfer direction;

a blowing unit provided with the aligning unit and configured to blow air toward the ejected sheet; and a setting unit configured to set whether to blow the air in accordance with information on the type of sheet to be ejected, wherein the blowing unit includes a blowing port formed on a sheet aligning face of the aligning unit.

8. The sheet ejecting device according to claim 7, further comprising a louver configured to be provided to the blowing port and change the direction in which the air is blown to a desired direction.

9. The sheet ejecting device according to claim 8, wherein the direction in which the air is blown includes the direction orthogonal to the direction in which the sheet is ejected and a direction oblique to the direction in which the sheet is ejected.

10. An image forming system comprising:

a sheet ejecting device, the sheet ejecting device includes:

a sheet ejecting unit configured to eject a sheet;

a stacking unit on which the sheet that is ejected by the ejecting unit is stacked;

an aligning unit configured to move in a direction perpendicular to the sheet transfer direction;

a blowing unit provided with the aligning unit and configured to blow air toward the ejected sheet; and a louver configured to be provided to the blowing unit and change the direction in which the air is blown to a desired direction, wherein the blowing unit includes a blowing port formed on a sheet aligning face of the aligning unit, and wherein the blowing unit includes an air guiding path configured to guide the air from a source of air.

* * * * *